United States Patent [19]

Yasumoto et al.

[11] Patent Number: 4,959,571

[45] Date of Patent: Sep. 25, 1990

[54] AXIAL-FLOW FAN WITH TAPERED HUB AND DUCT

[75] Inventors: Kazuhiro Yasumoto; Ippei Hagiwara, both of Nakatsugawa, Japan

[73] Assignee: Mitsubishi Denki Kabushiki Kaisha, Tokyo, Japan

[21] Appl. No.: 321,007

[22] Filed: Mar. 9, 1989

[30] Foreign Application Priority Data

Mar. 11, 1988 [JP] Japan ..... 63-57462

[51] Int. Cl.[5] ..... H02K 9/06; F04D 29/52

[52] U.S. Cl. ..... 310/67 R; 310/63; 310/91; 415/119; 416/222; 416/224

[58] Field of Search ..... 310/67 A, 68 D, 91; 415/119, 211.2, 142; 416/218, 220, 222, 223 R, 224 R

[56] References Cited

U.S. PATENT DOCUMENTS 2,926,838 3/1960 van Rijn ..... 310/67 R

FOREIGN PATENT DOCUMENTS 3227698 1/1984 Fed. Rep. of Germany .... 310/67 R
55-74245 5/1980 Japan .
56-54995 5/1981 Japan .
57-118649 7/1982 Japan .
62-68477 4/1987 Japan .
209710 4/1987 Japan ..... 415/119
943410 7/1982 U.S.S.R. ..... 415/119
1326778 7/1987 U.S.S.R. ..... 415/119

OTHER PUBLICATIONS

Radio Shack, "3" 120VAC Fan, '87 Catalog, p. 126.
"HLH" 27 Variation des Abstandes zwischen Laufrad und benachbarten Streben Ploner und Herz (17; 1969), HLH 27(1976) Nr. 8, Aug., pp. 288–290.

*Primary Examiner*—Steven L. Stephan
*Assistant Examiner*—D. L. Rebsch

[57] ABSTRACT

In an axial-flow fan, a motor support, a frame having a cylindrical inner surface, a boss fixed to the drive shaft and having a cylindrical outer surface, and blades radially extending from the cylindrical outer surface of the boss is provided legs for connecting the frame and motor support, and are also provided with surfaces inclined with respect to the direction of the air stream to reduce resistance to air flow. In another embodiment, the downstream end of the air duct defined by the cylindrical inner surface of the frame is gradually expanded toward the direction in which air is blown out. In a further embodiment, the upstream end of the boss has cut-away portions for enlarging the area of the cross section for air flow.

15 Claims, 7 Drawing Sheets

AXIAL-FLOW FAN WITH TAPERED HUB AND DUCT

BACKGROUND OF THE INVENTION

The present invention relates to an axial-flow fan.

FIG. 11 and FIG. 12 are an oblique view and a sectional view of a prior-art axial-flow fan, such as the one shown in Japanese Utility Model Application Kokai Publication No. 68477/1987. In the figures, a cylindrical air duct 2 is defined by a frame 1, and a motor support 4 is fixed to the frame 1 by means of legs 3. An electric motor 5 is supported by the motor support 4. A stator 6 is fixed to the motor support 4, while magnets are mounted on the motor support 4 via bearing 7, so that the magnets 8 can rotate, and the magnets 8 confront the stator 6. A blade assembly 10, formed integrally and of synthetic resin is disposed within the air duct 2. The blade assembly 10 comprises a cylindrical boss 10*a* and blades 10*b* connected to the cylindrical surface of the boss 10*a*.

When the stator 6 of the motor 5 is energized, a magnetic flux is generated, and because of the magnetomotive interaction between the rotor 9 and the magnets 8, the blade assembly 10 rotates. As a result, air is taken in from above as seen in FIG. 12, passed through the air duct 2, and blown out toward the bottom as seen in FIG. 12, through the openings between the legs 3.

It will be understood that the legs 3 are in the way of the air stream, and the legs 3 have surfaces normal to the direction of the air stream. Moreover, the air duct 2 is in the form of a cylinder whose side surfaces are formed of straight lines which are also called "generators". Furthermore, the boss 10*a* of the blade assembly 10 is cylindrical, so that its resistance to air flow is substantial.

SUMMARY OF THE INVENTION

An object of the invention is to eliminate the above problems.

Another object of the invention is to provide an axial-flow fan which can operate with less resistance to air flow, and hence with a higher efficiency, and low noise.

According to a first aspect of the invention, the legs have surfaces inclined with respect to the direction of the air stream. According to a second aspect of the invention, the openings on the exit side of the air duct are gradually expanded so that the area of the cross section of the opening is enlarged toward the exit end. With such construction, the resistance to air flow is reduced, so that the air volume is increased.

According to a third aspect of the invention, the boss of the blade assembly has cut-away portions formed on the side of air entry, so that the area for air intake is enlarged. According to a fourth aspect of the invention, these cut-away portions may be in the form of partial cones.

The features of the first to fourth aspects of the invention described above may all be combined to give all the advantages described above.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE EMBODIMENTS

Figure 1:
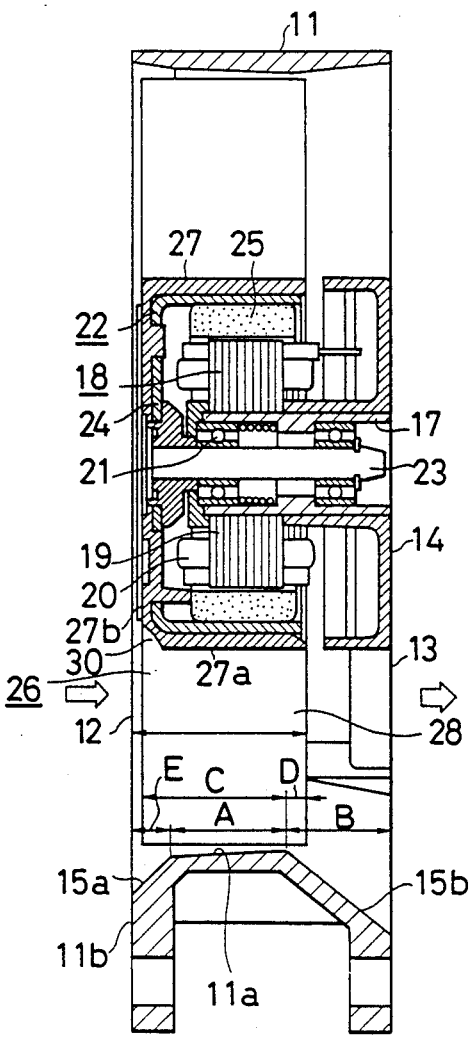
FIG. 1 is a sectional view, taken along line I—I in FIG. 2, showing an embodiment of the invention.
Figure 2:
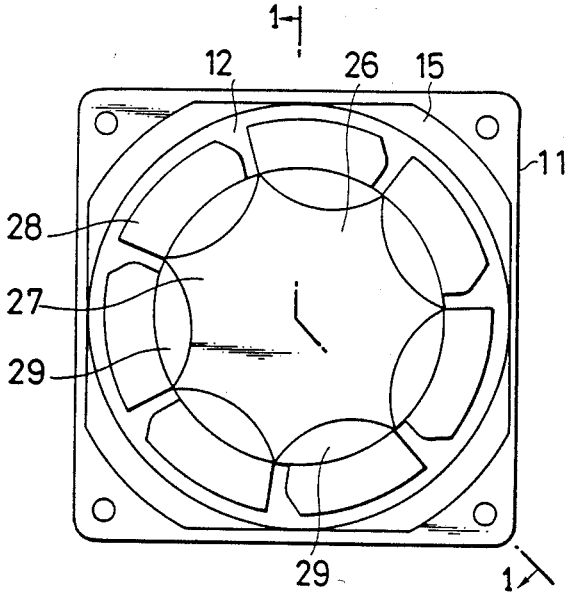
FIG. 2 is a front view of the embodiment of FIG. 1.
Figure 3:
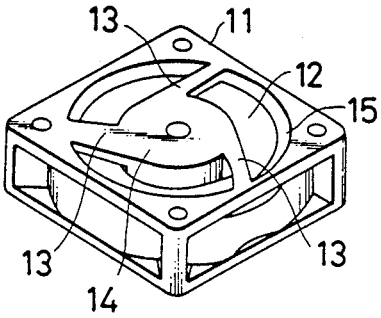
FIG. 3 is a rear view of the embodiment of FIG. 1.
Figure 4:
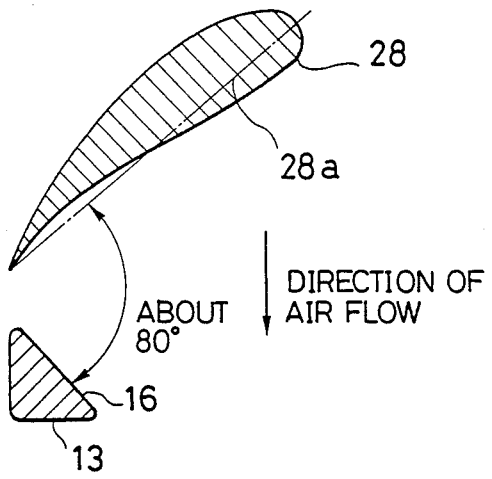
FIG. 4 is a sectional view showing the relationship between the blades 28 and legs 13.
Figure 5:
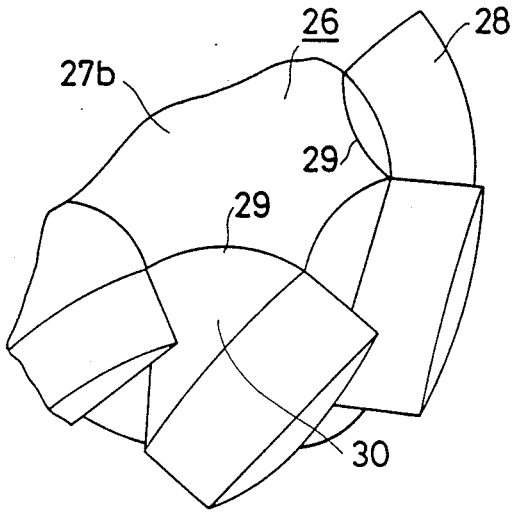
FIG. 5 is an oblique view, seen from the front, of the blade assembly 26.

FIG. 1 to FIG. 6 show an embodiment of the invention. A frame 11 has a cylindrical inner surface 11*a*, by which an air duct 12 is defined. A motor support 14 is disposed in the center of the air duct 12 and is fixed to the frame 11 by means of legs 13. A drive shaft 23 extends through and is supported by a bearing 21 so that it can rotate. The bearing 21 is disposed in a bearing holder 17, which in turn is provided in the motor support 14. A stator 18 is formed of stator cores 19 provided on the outer periphery of the bearing holder 17 and windings 20 are wound on the cores 19. A yoke 24 is formed integrally with the shaft 23. A rotor comprises of the shaft 23, the yoke 24 and the magnet 25 provided to confront the stator 18 in the inner wall of the yoke 24. A blade assembly 26 is formed integrally with the yoke 24 of the rotor. The blade assembly 26 comprises a boss 27 supporting the yoke 24 and blades 28 connected to the cylindrical surfaces of the boss 27 and extending radially from the axis of the blade assembly. An annular duct part is formed between the cylindrical inner surface 11*a* of the frame 11 and the cylindrical outer surface 27*a* of the boss 27.

The inner wall 11*a* of the frame 11 is provided with gradually expanded portions 15*a* and 15*b* on the entry side and exit side for the air stream. The gradually expanded portions 15*a* and 15*b* are so formed that the area of the cross section of the air duct 12 is increased toward the entry side end and exit side end, respectively. In the embodiment illustrated, the frame 11 has a generally rectangular outer shape having four corners, and the gradually expanded portions 15*a* and 15*b* are formed at the parts corresponding to the four corners.

The legs 13 have surfaces 16 inclined with respect to the direction of air stream. Thus, the inclined surfaces 16 provided to confront, although obliquely, the incoming air stream replace the flatly confronting surfaces of the prior art. The inclined surfaces 16 are inclined so that the angle between the inclined surfaces 16 and the blade chord line 28*a* of the blades is about 80°. The blade chord line is about 35° with respect to the plane normal to the drive shaft of the motor.

Figure 6:
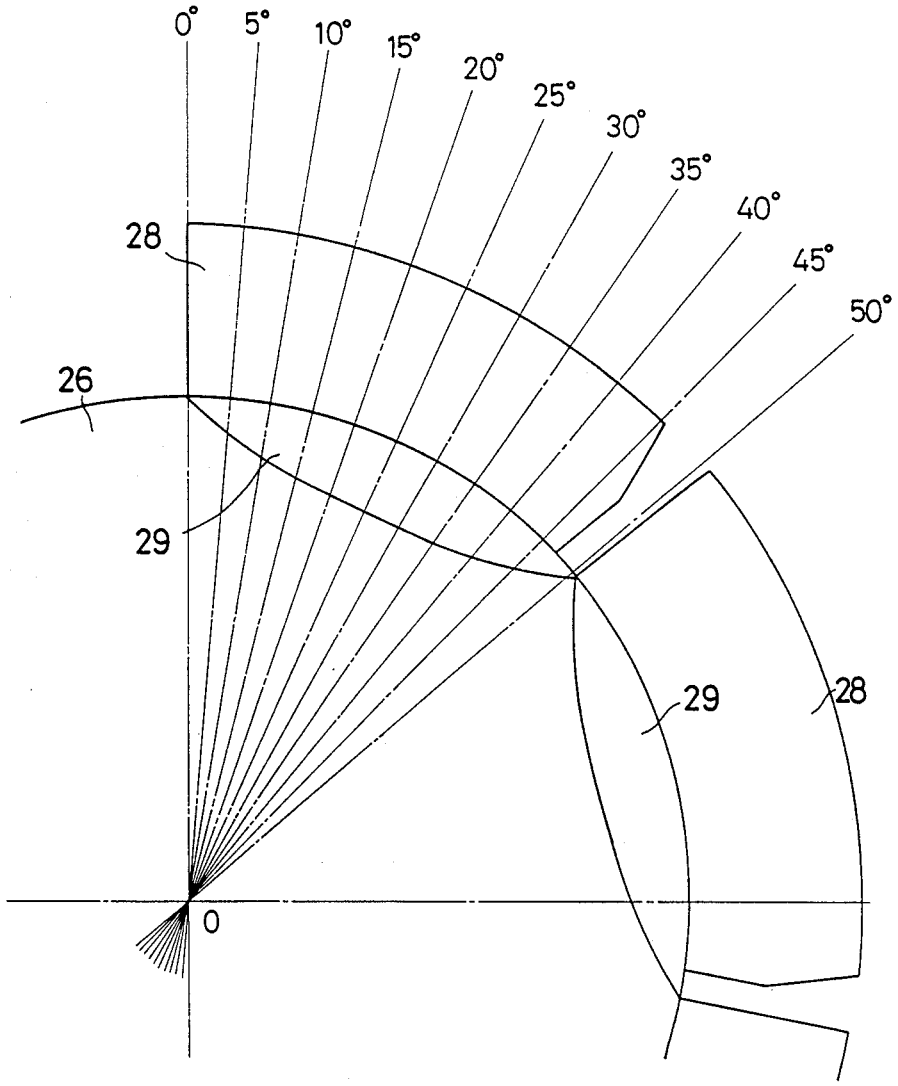
FIG. 6 is a front view showing coordinate lines of the blade assembly 26.

The boss 27 has cut-away portions or dents 30 each defining an arcuate edge 29 with a generally flat front surface 27*b* of the boss 27. Each dent 30 defines a surface which is generally part of a cone, tapered toward the rear (downstream) side of the boss. Each cone may be so formed that it is continuous with the root part of the blade at which the blade is joined with the cylindrical wall of the boss. An example of the shape of the dent at various points is defined by the following set of coordinates ($\theta$, X, Z), where $\theta$ represents the angle of rotation about the axis of the boss 27 as seen in FIG. 6, X represents the distance from the axis of the boss 27, and Z represents the distance from a plane 6.4 mm shifted toward the downstream side from the front surface 27*b* of the boss 27.

It is assumed that the radius of the boss is 21.00 mm.

| | | | | | | | | |
|---|---|---|---|---|---|---|---|---|
| $\theta$ = 5° | | | | | | | | |
| X = | 18.50 | 18.52 | 19.00 | 19.50 | 20.00 | 20.50 | 21.00 | |
| Z = | 6.40 | 6.40 | 6.30 | 6.15 | 6.09 | 6.11 | 6.17 | |
| $\theta$ = 10° | | | | | | | | |
| X = | 16.97 | 17.20 | 17.50 | 18.00 | 18.50 | 19.00 | 19.50 | 20.00 |
| Z = | 6.40 | 6.40 | 6.31 | 6.08 | 5.89 | 5.76 | 5.68 | 5.64 |
| X = | 20.50 | 21.00 | | | | | | |
| Z = | 5.63 | 5.63 | | | | | | |
| $\theta$ = 15° | | | | | | | | |
| X = | 16.10 | 16.41 | 16.50 | 17.00 | 17.50 | 18.00 | 18.50 | 19.00 |
| Z = | 6.40 | 6.40 | 6.33 | 6.19 | 5.95 | 5.63 | 5.33 | 5.11 |
| X = | 19.50 | 20.00 | 20.50 | 21.00 | | | | |
| Z = | 4.98 | 4.89 | 4.84 | 4.80 | | | | |
| $\theta$ = 20° | | | | | | | | |
| X = | 15.61 | 16.00 | 16.50 | 17.00 | 17.50 | 18.00 | 18.50 | 19.00 |
| Z = | 6.40 | 6.39 | 6.21 | 5.98 | 5.68 | 5.34 | 4.94 | 4.54 |
| X = | 19.55 | 20.00 | 20.50 | 21.00 | | | | |
| Z = | 4.18 | 3.96 | 3.80 | 3.73 | | | | |
| $\theta$ = 25° | | | | | | | | |
| X = | 15.43 | 15.81 | 16.00 | 16.50 | 17.00 | 17.50 | 18.00 | 18.50 |
| Z = | 6.40 | 6.40 | 6.32 | 6.15 | 5.89 | 5.53 | 5.11 | 4.65 |
| X = | 19.00 | 19.50 | 20.00 | 20.50 | 21.00 | | | |
| Z = | 4.09 | 3.36 | 2.93 | 2.64 | 2.42 | | | |
| $\theta$ = 30° | | | | | | | | |
| X = | 15.50 | 15.90 | 16.00 | 16.50 | 17.00 | 17.50 | 18.00 | 18.50 |
| Z = | 6.40 | 6.40 | 6.36 | 6.18 | 5.94 | 5.54 | 5.11 | 4.56 |
| X = | 19.00 | 19.50 | 20.00 | 20.50 | 21.00 | | | |
| Z = | 3.96 | 3.18 | 2.44 | 1.64 | 0.81 | | | |
| $\theta$ = 35° | | | | | | | | |
| X = | 15.85 | 16.25 | 16.50 | 17.00 | 17.50 | 18.00 | 18.50 | 19.00 |
| Z = | 6.40 | 6.40 | 6.31 | 6.11 | 5.77 | 5.34 | 4.78 | 4.11 |
| X = | 19.50 | 20.00 | 20.50 | 21.00 | | | | |
| Z = | 3.23 | 1.96 | 0.44 | −1.21 | | | | |
| $\theta$ = 40° | | | | | | | | |
| X = | 16.53 | 16.93 | 17.00 | 17.50 | 18.00 | 18.50 | 19.00 | 19.50 |
| Z = | 6.40 | 6.40 | 6.37 | 6.20 | 5.82 | 5.39 | 4.69 | 3.81 |
| X = | 20.00 | 20.50 | 21.00 | | | | | |
| Z = | 2.39 | 0.48 | −3.73 | | | | | |
| $\theta$ = 45° | | | | | | | | |
| X = | 17.73 | 18.07 | 18.50 | 19.00 | 19.50 | 20.00 | 20.50 | 21.00 |
| Z = | 6.40 | 6.40 | 6.19 | 5.74 | 4.89 | 3.19 | 0.63 | −6.43 |
| $\theta$ = 50° | | | | | | | | |

-continued

| | | | | |
|---|---|---|---|---|
| X = | 20.00 | 20.09 | 20.50 | 21.00 |
| Z = | 6.40 | 6.40 | 5.40 | −9.60 |

Figure 7:
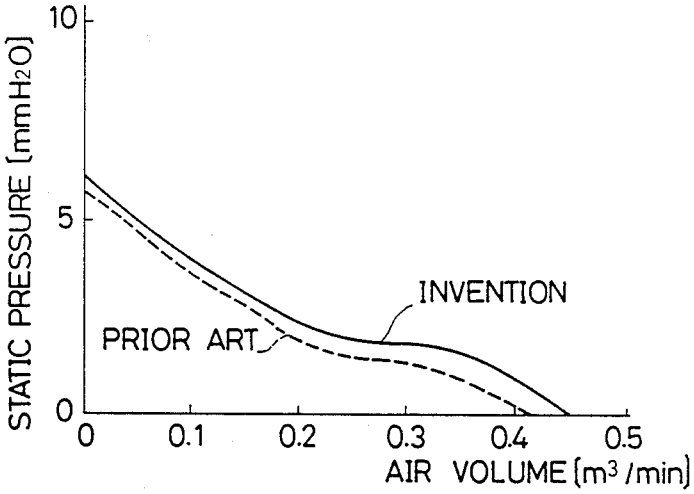
FIG. 7 is a diagram showing air volume versus static pressure characteristics for comparing the cases with and without inclined surfaces 16 on legs 13.

In the axial-flow fan described above, when the windings 20 on the stator 18 are energized, magnetic flux is generated, and because of the magnetomotive interaction between the magnets 25 and the windings 20, the blade assembly 26 rotates about its axis, and air is taken in from the upstream side, or the left side as seen in FIG. 1 and blown out toward the right side as seen in FIG. 1, or the downstream side. The legs 13 are in the air duct 12 and form a resistance to air flow. But as the legs 13 have inclined surfaces 16 inclined with respect to the direction of the incoming air stream, the resistance to air flow is smaller than the conventional legs having surfaces normal to the incoming direction of the air stream. As a result, air volume is increased as indicated in FIG. 7. In this figure, the relationship between the static pressure and the air volume is shown. For the same static pressure, the invention (solid line) gives a greater air volume than the prior art (broken line).

Figure 8:
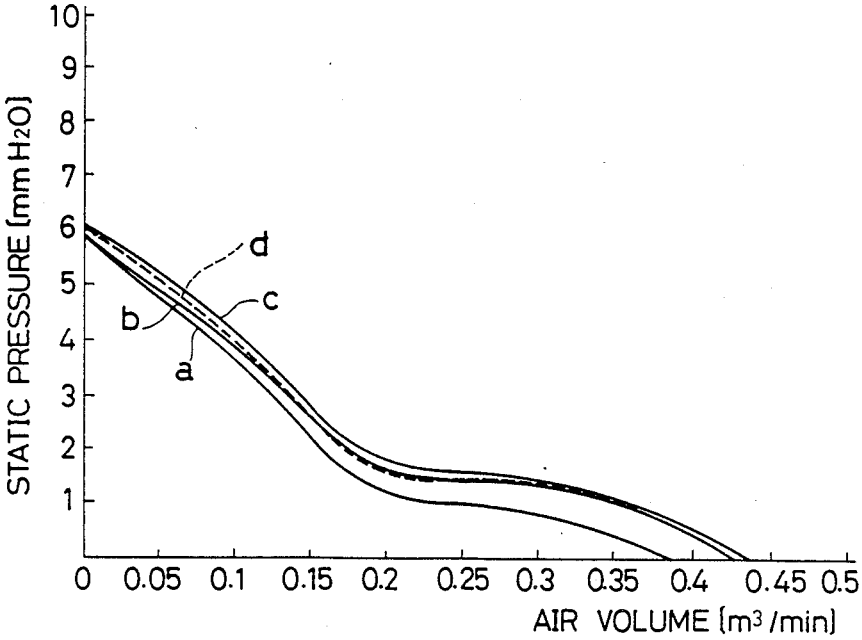
FIG. 8 is a diagram showing air volume versus static pressure characteristics for different angles of the gradually expanded sections 15.

Moreover, the gradually expanded portions 15 at the entry side and the exit side of the air duct also serve to reduce the resistance to air flow. FIG. 8 shows the variation in the air volume when the dimensions A and B as indicated in FIG. 1 are varied while the dimension E, the distance from the front end surface 11*b* of the frame 11 to the rear end of the gradually expanded portion 15*a* at the entry side is fixed at 6 mm. The curve a shows the case in which no expanded portions are provided, curve b shows a case in which the dimension A is 11 mm and the dimension B is 8 mm, curve c shows the case in which the dimension A is 6.5 mm and the dimension B is 12.5 mm, and the curve d shows the case in which the dimension A is 0 mm and the dimension B is 19 mm. It will be seen from FIG. 8, the case of the curve c gives the best result. In this case, it is assumed that the blades 28 are positioned so that C:D=5:1, where C denotes the distance from the front edge of the blade (the leading edge) to the front edge of the gradually expanded portion of the exit end part of the cylindrical inner surface of the frame, and D denotes the distance from the front edge of the gradually expanded portion of the exit end part of the cylindrical inner surface of the frame to the rear edge of the blade (the trailing edge).

Figure 9:
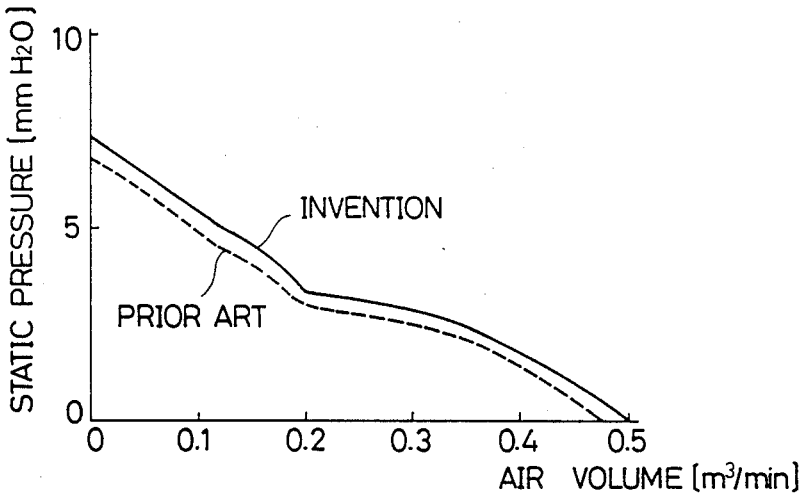
FIG. 9 is a diagram showing air volume versus static pressure characteristics for comparing the cases with and without cut-away grooves 30 on a boss 27.

Furthermore, the boss 27 has dents 30 on the outer periphery. As a result, the area for entry of air is greater than in the configuration of the prior art. The air volume is therefore greater, as shown in FIG. 9.

Figure 10:
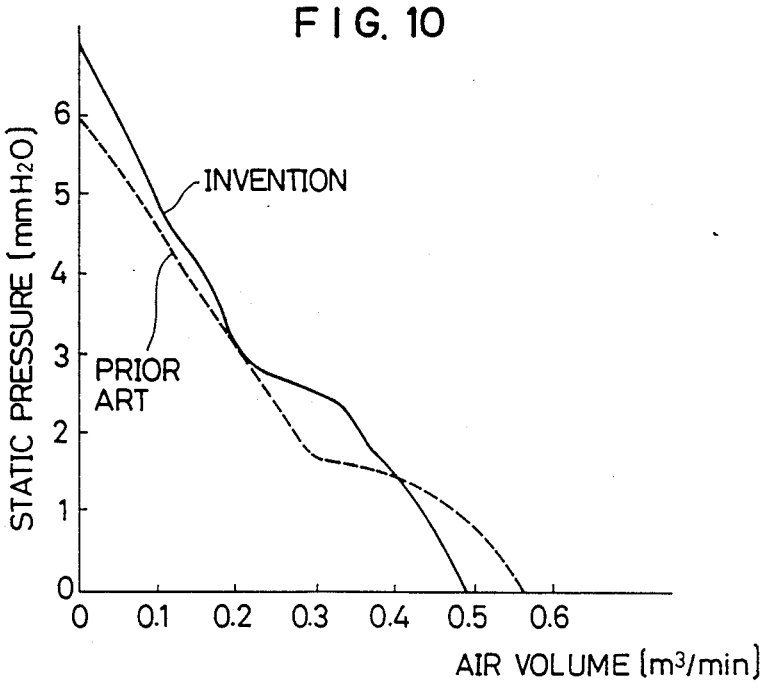
FIG. 10 is a diagram showing air volume versus static pressure characteristics for comparing the case with all of the inclined surfaces 16 on the legs 13, the gradually expanded sections 15, and the cut-away portions 30, and the case without them.
Figure 11:
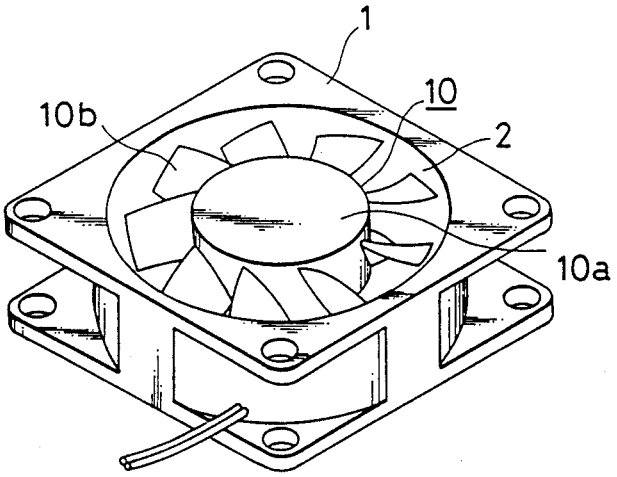
FIG. 11 PRIOR ART
FIG. 11 is an oblique view showing a prior-art axial-flow fan.
Figure 12:
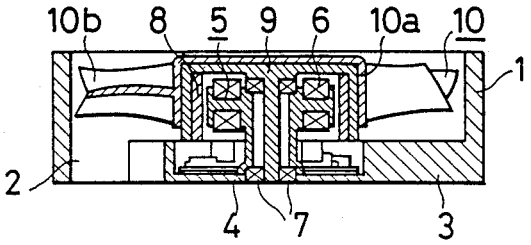
FIG. 12 PRIOR ART
FIG. 12 is a sectional view showing the prior-art axial-flow fan.

When all of the above features are incorporated, the results shown in FIG. 10 can be obtained. It will be appreciated from FIG. 10, that the increase in the air volume is particularly substantial for higher static pressure.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An axial-flow fan comprising:

a motor having a drive shaft;

a motor support for supporting the motor;

a frame having a generally cylindrical inner surface;

legs each having one end connected to the frame and the other end connected to the motor support for supporting the motor support;

a boss fixed to the drive shaft and having a generally cylindrical outer surface; and blades radially extending from the cylindrical outer surface of the boss;

said boss and blades being driven by said motor to cause an air stream along an axis of the motor;

wherein said legs each have three generally flat sides, one of said sides being inclined with respect to the direction of the incoming air stream.

2. The axial-flow fan according to claim 1, wherein said inclined side of the legs are at about 80° with respect to a blade chord line of the blades.

3. The axial-flow fan according to claim 2, wherein the blade chord line is at about 35° inclined relative to the plane normal to the drive shaft of the motor.

4. An axial-flow fan comprising:

a motor having a drive shaft;

a boss fixed to the drive shaft and having a generally cylindrical outer surface;

blades radially extending from the cylindrical surface of the boss;

said boss and blades being driven by said motor to cause an air stream along an axis of the motor;

a frame having a generally cylindrical inner surface having an exit defined on a downstream side thereof for said air stream; and an annular air duct being formed between the cylindrical inner surface of the frame and the cylindrical outer surface of said boss;

wherein at least a portion along the periphery of said exit is gradually expanded toward said downstream side and wherein said boss has an entry defined on an upstream side thereof, said entry of the boss having cut-away portions for enlarging a cross-sectional area thereof for entry of the air stream into said annular air duct.

5. The axial-flow fan according to claim 4, wherein said frame has a generally rectangular outer shape having four corners, and said exit of said inner surface is gradually expanded at portions thereof corresponding to the four corners.

6. The axial-flow fan according to claim 4, wherein said cylindrical inner surface of said frame also has an entry defined on the upstream side thereof for said air stream, wherein at least part of the entry of the cylindrical inner surface along a periphery of said entry is gradually expanded toward said upstream side.

7. The axial-flow fan according to claim 6, wherein said frame has a generally rectangular outer shape having four corners, and said entry of said inner surface is gradually expanded at portions thereof corresponding to the four corners.

8. An axial-flow fan comprising:

a motor having a drive shaft;

a frame having a generally cylindrical inner surface;

a boss fixed to the drive shaft and having a generally cylindrical outer surface;

an annular air duct part being formed between the cylindrical inner surface of said frame and the cylindrical outer surface of said boss; and blades radially extending from the cylindrical outer surface of the boss;

said boss and blades being driven by said motor to cause an air stream along an axis of the motor;

said boss having an entry defined on an upstream side thereof for the air stream;

wherein said entry of said boss has cut-away portions for enlarging a cross-sectional area thereof for the entry of the air stream into said annular air duct part.

9. The axial-flow fan according to claim 8, wherein said cut-away portions have a cross section enlarged toward the upstream side thereof.

10. The axial-flow fan according to claim 9, wherein each of said cut-away portions is in the form of part of a cone tapered toward the downstream side thereof.

11. The axial-flow fan according to claim 4, wherein said cut-away portions have a cross section reduced toward the downstream side.

12. The axial-flow fan according to claim 4, wherein said cylindrical inner surface of said frame also has an entry defined on the upstream side for said air stream; wherein at least part of the entry of the cylindrical inner surface along a periphery of said entry is gradually expanded toward said upstream side.

13. The axial-flow fan according to claim 12, wherein said frame has a generally rectangular outer shape having four corners, and said exit and said entry of said inner surface are gradually expanded at portions thereof corresponding to the four corners.

14. An axial-flow fan comprising:

a motor having a drive shaft;

a motor support for supporting the motor;

a frame having a generally cylindrical inner surface and having an exit defined on a downstream side thereof for said air stream;

legs each having one end connected to the frame and the other end connected to the motor support for supporting the motor support;

a boss fixed to the drive shaft and having a generally cylindrical outer surface; and blades radially extending from the cylindrical outer surface of the boss;

said boss and blades being driven by said motor to cause an air stream along the axis of the motor;

wherein said legs have a surface inclined with respect to the direction of the incoming air stream;

an annular air duct part is formed between the cylindrical inner surface of said frame and the cylindrical outer surface of said boss;

at least part of the entry of the cylindrical inner surface along the periphery of said exit is gradually expanded toward said downstream side;

said boss has an entry defined on an upstream side thereof for the air stream; and said entry of said boss has cut-away portions for enlarging a cross-sectional area thereof for the entry of the air stream into said annular air duct part.

15. The axial-flow fan according to claim 14, wherein said cylindrical inner surface of said frame also has an entry defined on the upstream side thereof for said air stream; and at least part of the entry along a periphery thereof is also gradually expanded toward said upstream side.

* * * * *